US008644718B2

(12) United States Patent
Oya

(10) Patent No.: US 8,644,718 B2
(45) Date of Patent: Feb. 4, 2014

(54) IMAGE FORMING APPARATUS HAVING ROTARY DEVELOPING UNIT, METHOD FOR CONTROLLING, AND STORAGE MEDIUM

(75) Inventor: Hiroshi Oya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 13/234,151

(22) Filed: Sep. 16, 2011

(65) Prior Publication Data

US 2012/0070167 A1 Mar. 22, 2012

(30) Foreign Application Priority Data

Sep. 21, 2010 (JP) ..... 2010-210725

(51) Int. Cl.
*G03G 15/01* (2006.01)

(52) U.S. Cl.
USPC ..... 399/28; 399/227

(58) Field of Classification Search
USPC ..... 399/28, 54, 223, 227
See application file for complete search history.

(56) References Cited

U.S. PATENT DOCUMENTS

| | | | | |
|---|---|---|---|---|
| 6,327,449 | B1 * | 12/2001 | Matsuzaki | 399/227 |
| 6,763,202 | B2 * | 7/2004 | Maeda | 399/53 |
| 7,065,304 | B2 * | 6/2006 | Taguchi | 399/12 |
| 7,085,520 | B2 * | 8/2006 | Yamada et al. | 399/227 |
| 7,123,863 | B2 * | 10/2006 | Yamada et al. | 399/227 |
| 7,313,334 | B2 * | 12/2007 | Inukai | 399/12 |
| 7,460,818 | B2 * | 12/2008 | Kozuma | 399/227 |
| 7,672,617 | B2 * | 3/2010 | Sugimoto et al. | 399/227 |

FOREIGN PATENT DOCUMENTS

| | | | |
|---|---|---|---|
| EP | 678794 | A2 * | 10/1995 |
| JP | 06-258905 | A | 9/1994 |
| JP | 2003-323027 | A | 11/2003 |

* cited by examiner

*Primary Examiner* — Robert Beatty
(74) *Attorney, Agent, or Firm* — Fitzpatrick, Cella, Harper & Scinto

(57) ABSTRACT

A controller unit determines the operation mode of a device when an error relating to a color cartridge has been detected. When the controller unit determines that the operation mode of the device is a toner replacement priority mode, the controller unit determines whether or not the number of times a monochrome printing job has been executed is equal to or greater than a threshold value without resolving the error. When the number of times a monochrome printing job has been executed is equal to or greater than a threshold value without resolving the error, the controller unit switches the operation mode of the device to a monochrome performance priority mode.

6 Claims, 7 Drawing Sheets

FIG. 7

Operation settings to be made when "no color toner" occurs

- [ ] Automatic switch mode
- [x] Manually setting mode
  - [x] Prioritize monochrome printing performance
  - [ ] Prioritize toner replacement operability

IMAGE FORMING APPARATUS HAVING ROTARY DEVELOPING UNIT, METHOD FOR CONTROLLING, AND STORAGE MEDIUM

BACKGROUND OF THE INVENTION

1. Field of the Invention

The present invention relates to an image forming apparatus, a method for controlling the same, and a storage medium for the same.

2. Description of the Related Art

An image forming apparatus (for example, rotation developing rotary-type image forming apparatus) that rotationally moves a plurality of toner cartridges serving as recording material storage units to perform printing has been proposed. When an error such as "no toner" or the like occurs in a toner cartridge, such image forming apparatus moves the toner cartridge in which the error has occurred to the replacement position such that a user can replace the toner cartridge.

For example, Japanese Patent Laid-Open No. 06-258905 discloses an image forming apparatus that detects the fact that the consumption of a developing agent stored in a developing cartridge has been completed, and places the developing cartridge, in which the consumption of the developing agent stored therein has been completed, at the replacement position upon ending formation of an image. Also, Japanese Patent Laid-Open No. 2003-323027 discloses an image processing apparatus that detects the respective amounts of toner contained in the toner cartridges and moves a toner cartridge, of which the detected amount of toner is the smallest, to the replacement position.

An image forming apparatus that rotationally moves a plurality of toner cartridges to perform printing has a standby position (arrangement position) for a toner cartridge so as to start printing in the quickest manner. When a toner cartridge is at the standby position, the image forming apparatus can start printing in the quickest manner. On the other hand, when the image forming apparatus attempts to start printing when a toner cartridge is not at the standby position, the image forming apparatus once moves the toner cartridge to the standby position and then executes printing. Consequently, a delay in the start of printing the first page may occur. In other words, a so-called first printing is delayed.

Assume the case in which a toner cartridge with no toner is a toner cartridge (color cartridge) other than the black toner cartridge that contains a color toner. In this case, the image forming apparatus is incapable of executing color printing, but capable of executing monochrome printing that employs only a toner cartridge containing black toner (black toner cartridge). However, if the image forming apparatus is controlled so as to automatically move the toner for which the error has been detected to the replacement position for improvement in usability, the image forming apparatus moves the color cartridge to the replacement position when "no toner" occurs in a color cartridge. In this state, when the image forming apparatus receives a print job for monochrome printing, the toner cartridge is not at the standby position for starting printing in the quickest manner, and thus, the start of printing is delayed.

For example, when "no toner" occurs in a color cartridge during color printing, the image forming apparatus once cancels a print job being printed and attempts to execute new monochrome printing. In such a case, the start of monochrome printing is delayed. Also, when a replacement toner cartridge is not at hand, the image forming apparatus attempts to employ monochrome printing only until a replacement toner cartridge is reached. In such a case, the start of monochrome printing is also delayed each time.

In order to prevent the start of monochrome printing described above from being delayed, it is contemplated that the image forming apparatus performs the following operation when it can perform printing using the remaining toner in a particular toner cartridge (for example, black toner cartridge). Specifically, once the image forming apparatus performs printing using a particular toner cartridge, the image forming apparatus does not move a toner cartridge other than the particular toner cartridge to the replacement position, but always moves the particular toner cartridge to the standby position even if "no toner" occurs in any toner cartridge other than the particular toner cartridge. By this construction, even if "no toner" occurs in any toner cartridge other than the particular toner cartridge, the image forming apparatus is always capable of starting printing in the quickest manner.

However, when emphasizing printing performance in this manner, the usability may be affected. More specifically, when attempting to replace a toner cartridge for which "no toner" has occurred with a new toner cartridge, the toner cartridge to be replaced is not at the replacement position, and thus cannot be replaced promptly. In order to replace a toner cartridge, a user operation made from a user interface unit such as a panel on an image forming apparatus, an application on a PC connected to an image forming apparatus, or the like is required to move the toner cartridge to the replacement position, resulting in a considerable time and labor. If the image forming apparatus is not controlled so as to automatically move the toner cartridge for which the error has been detected to the replacement position, such an extra time and labor may occur, resulting in a decrease in usability.

SUMMARY OF THE INVENTION

The image forming apparatus of the present invention rotationally moves a plurality of recording material storage units to thereby perform printing, and switches the operation mode of the image forming apparatus to either an operation mode that prioritizes the replacement of a recording material storage unit for which the error has occurred or the other operation mode that starts printing using a particular recording material storage unit in the quickest manner depending on the state of the apparatus.

According to an aspect of the present invention, an image forming apparatus that rotationally moves a plurality of recording material storage units that store a recording material to thereby perform printing is provided that includes a moving unit configured to rotationally move the recording material storage unit; a switching unit configured to switch the operation mode of the image forming apparatus to either a first operation mode that prioritizes avoiding an error relating to the recording material or a second operation mode that prioritizes a monochrome printing performance; and a determination unit configured to determine the operation mode of the image forming apparatus when an error relating to a color recording material different from a black recording material has been detected, wherein the moving unit moves a recording material storage unit that contains a recording material for which the error has been detected to a different position depending on the determination of the operation mode of the image forming apparatus by the determination unit, and wherein, when the determination unit determines that the operation mode of the image forming apparatus is the first operation mode and the number of times a monochrome printing job has been executed is equal to or greater than a threshold value without resolving the error, the switching unit switches the operation mode of the image forming apparatus to the second operation mode.

Further features of the present invention will become apparent from the following description of exemplary embodiments with reference to the attached drawings.

BRIEF DESCRIPTION OF THE DRAWINGS

FIG. 7 is an example of a user interface for selectively inputting the operation mode.

DESCRIPTION OF THE EMBODIMENTS

Figure 1A:
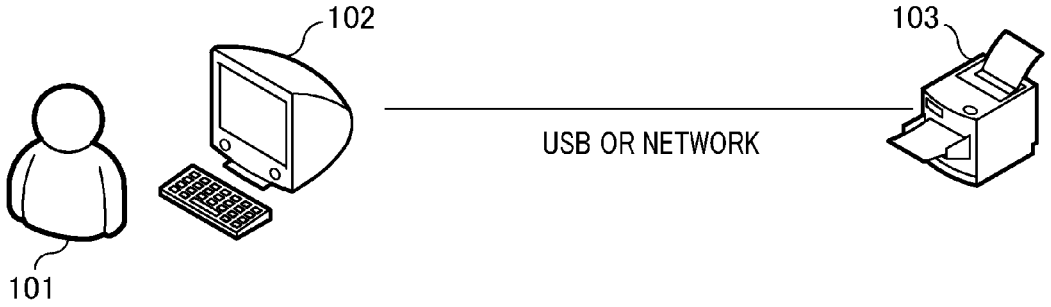
FIG. 1A is a diagram illustrating an example of the system configuration of the present embodiment.
Figure 1B:
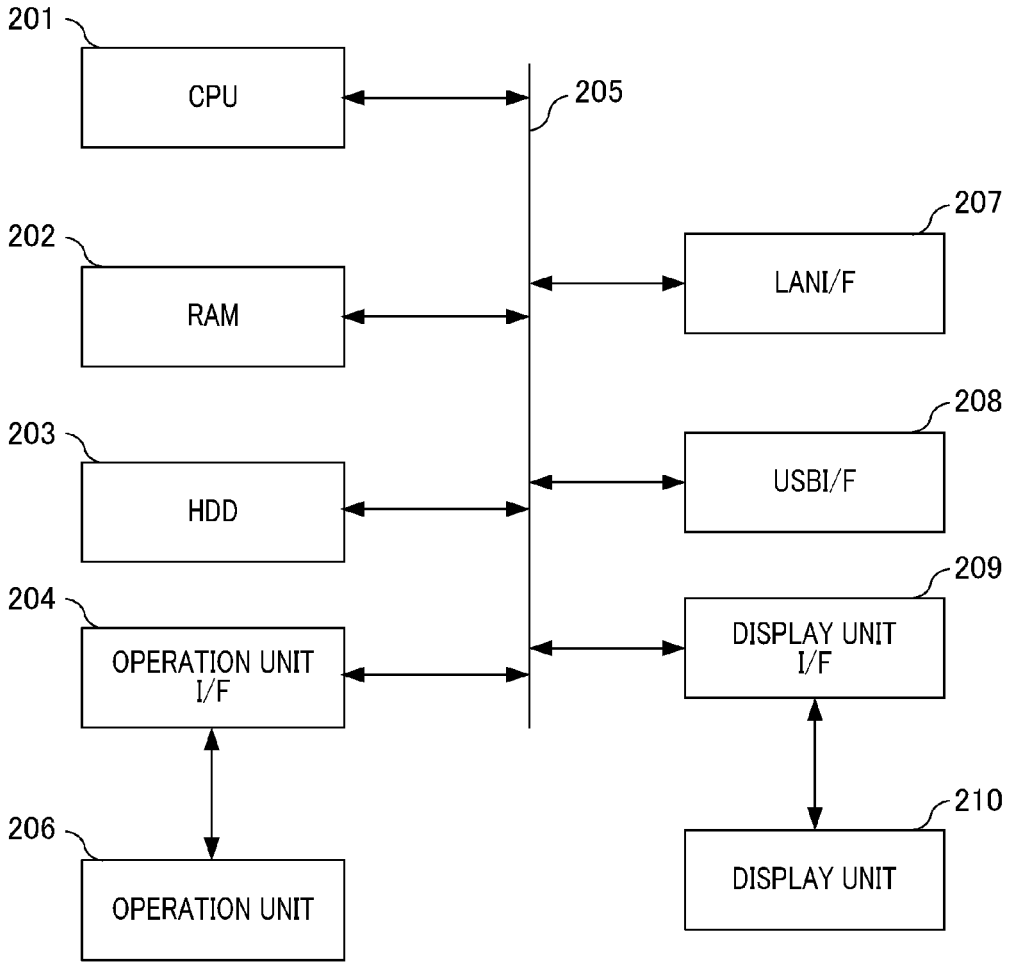
FIG. 1B is a diagram illustrating an example of the hardware configuration of a PC.

FIGS. 1A and 1B are diagrams illustrating an example of the system configuration of the present embodiment and an example of the hardware configuration of a PC, respectively. FIG. 1A is a diagram illustrating an example of the system configuration of the present embodiment. The system shown in FIG. 1A includes a PC (Personal Computer) 102 and a device 103. The PC 102 and the device 103 are connected to each other via a communication cable (e.g., USB or the like) or a network, where USB is an abbreviation for Universal Serial Bus. The PC 102 is an information processing apparatus that is operated by a user 101.

The user 101 can employ a UI (User Interface) application that operates on the PC 102 to thereby provide any setting or instruction to the device 103. The device 103 is the image forming apparatus of the present embodiment. The device 103 rotationally moves a plurality of recording material storage units (toner cartridges) that store toner serving as a recording material to thereby perform printing. In the following description, a toner cartridge is simply referred to as a "cartridge". For example, the device 103 is a color printing apparatus.

FIG. 1B is a diagram illustrating an example of the hardware configuration of the PC 102 shown in FIG. 1A. The PC 102 includes a CPU (Central Processing Unit) 201 and a RAM (Random Access Memory) 202. The PC 102 also includes a HDD (Hard Disk Drive) 203, an operation unit I/F (Interface) 204, and an operation unit 206. The PC 102 further includes a LAN (Local Area Network) I/F 207, a USB I/F 208, a display unit I/F 209, and a display unit 210. The respective devices provided in the PC 102 are arranged on a system bus 205.

The CPU 201 is a processor that controls the overall PC 102. The RAM 202 is a system working memory where the CPU 201 operates. The RAM 202 is employed as a program memory for recording a program. The HDD 203 is a data storage region. The operation unit I/F 204 is an interface unit that mediates an input/output of information to/from the operation unit 206. The operation unit I/F 204 receives an input signal from the operation unit 206. Also, the operation unit I/F 204 conveys information input by a user to the CPU 201 via the operation unit 206. The display unit I/F 209 is an interface unit that mediates the input/output of information to/from the display unit 210.

The display unit I/F 209 outputs an output signal to the display unit 210 in accordance with the control by the CPU 201. The USB I/F 208 is a functional unit for connecting to a USB device. The USB I/F 208 is employed for acquiring or returning the state of other device(s) via a USB. The LAN I/F 207 is a functional unit for connecting to LAN. The LAN I/F 207 is employed for acquiring or returning the state of other device(s) via LAN.

Figure 2:
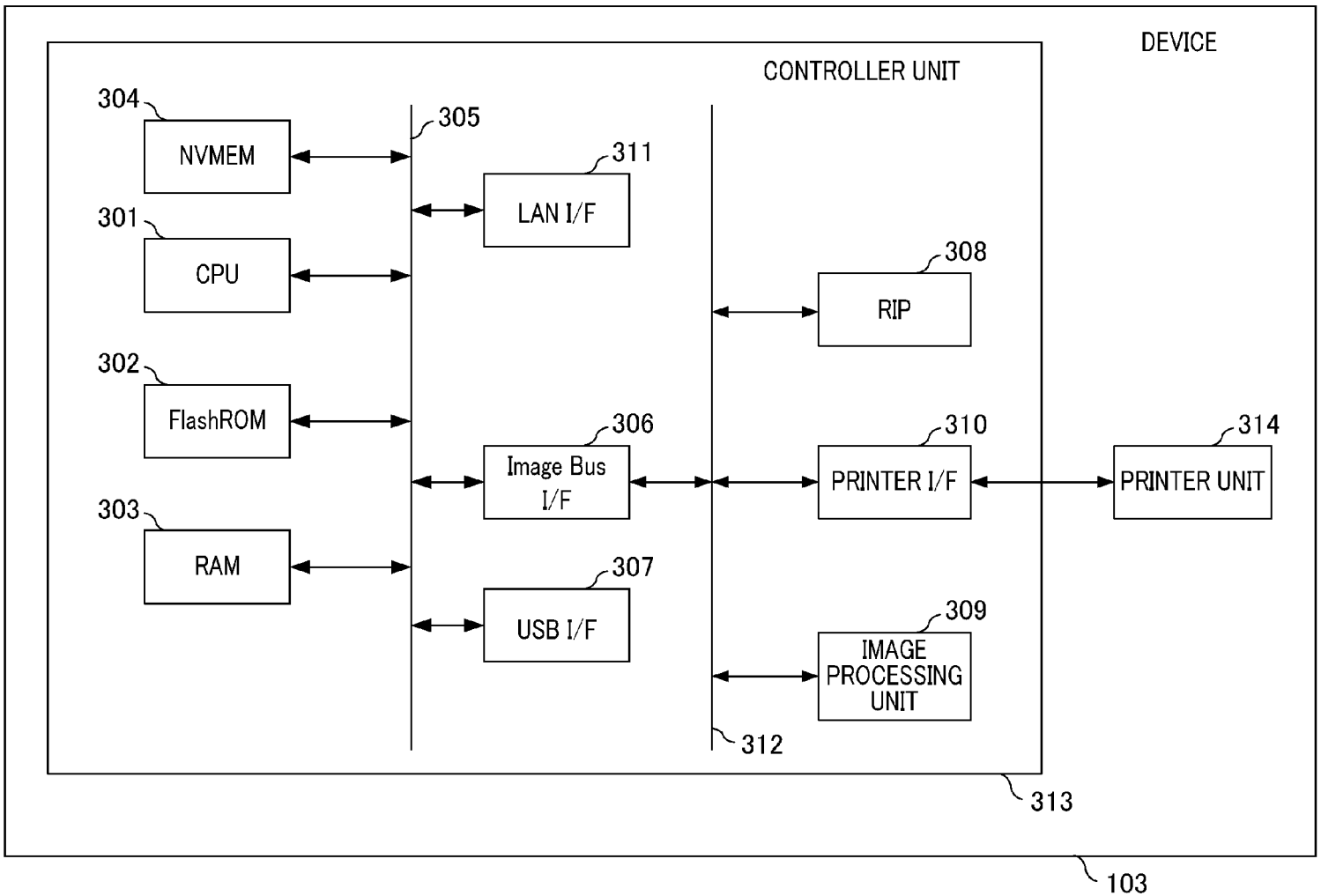
FIG. 2 is a diagram illustrating an example of the hardware configuration of a device.

FIG. 2 is a diagram illustrating an example of the hardware configuration of the device 103 shown in FIG. 1A. The device 103 includes a controller unit 313 and a printer unit 314. The controller unit 313 controls the overall device 103. More specifically, a method for controlling the image forming apparatus of the present embodiment and a storage medium for the same can be realized by the functions of the controller unit 313. The controller unit 313 provides an instruction to the printer unit 314, and causes it to execute image data print processing. Also, the controller unit 313 acquires information indicating the state of the device 103 from the printer unit 314.

Examples of information indicating the state of the device 103 include error information relating a toner cartridge provided in the device 103. Error information relating a toner cartridge is information indicating the occurrence of a so-called toner error. Examples of error information include information indicating "no toner". Also, examples of information indicating the state of the device 103 include information indicating that the device 103 is in the printing state or the print completion state, information indicating that a toner cartridge has been replaced, and information relating to a job input or a job cancellation.

The controller unit 313 provides a toner cartridge movement instruction to the printer unit 314 depending on the operation mode of the device 103 and the state of the device 103 acquired from the printer unit 314. In the present embodiment, the device 103 has two operation modes: a monochrome performance priority mode and a toner replacement priority mode. The monochrome performance priority mode and toner replacement priority mode will be described below. A toner cartridge movement instruction includes a replacement position movement instruction and a standby position movement instruction. The replacement position movement instruction is an instruction for moving a toner cartridge to the replacement position. The standby position movement instruction is an instruction for moving a toner cartridge to the standby position.

The printer unit 314 executes print processing in accordance with the instruction given by the controller unit 313. Also, the printer unit 314 acquires the state of the device 103 and transmits it to the controller unit 313. Furthermore, the printer unit 314 receives a toner cartridge movement instruction from the controller unit 313, and rotationally moves the toner cartridge to the position indicated by the movement instruction. More specifically, each of the controller unit 313 and the printer unit 314 functions as a moving unit configured to rotationally move the toner cartridge.

The controller unit 313 includes a CPU 301, a Flash ROM (Read Only Memory) 302, and a RAM 303. The controller unit 313 also includes an NVMEM (Non-Volatile Memory) 304, a LAN I/F 311, an Image Bus I/F 306, and a USB I/F 307. The controller unit 313 further includes a RIP (Raster Image Processor) 318, a printer I/F 310, and an image processing unit 309.

The CPU 301 is a processor that controls the controller unit 313 overall. The RAM 303 is a system working memory where the CPU 301 operates. The RAM 303 is a program memory for recording a program or an image memory for temporarily recording image data. The NVMEM 304 is a non-volatile memory that records setting information or the like.

The Flash ROM 302 is a rewritable non-volatile memory. The Flash ROM 302 stores various control programs for controlling the device 103 in advance. The USB I/F 307 enables the PC 102 to be connected to USB devices. The LAN I/F 311 enables the PC 102 to be connected to LAN. The Image Bus I/F 306 is a bus bridge that connects a system bus 305 to an image bus 312 that transfers image data at high speed to thereby convert data structure. The components from the CPU 301 to the USB I/F 307 are arranged on the system bus 305.

The image bus 312 includes a PCI (Peripheral Component Interconnect) bus or an IEEE 1394. The RIP 308, the printer I/F 310, and the image processing unit 309 are arranged on the image bus 312. The RIP 308 expands vector data such as a PDL (Page Description Language) code to bitmap image data (raster image data). The printer I/F 310 connects the printer unit 314 to the controller unit 313 to thereby perform synchronous/asynchronous conversion of image data and exchange of data.

The image processing unit 309 performs correcting, modifying, editing for input image data, and performs printer correction, resolution conversion, and the like for print output image data. Also, the image processing unit 309 performs image data rotation or performs compression/decompression processing such as JPEG for multilevel-image data and such as JBIG, MMR, MH, or the like for binary image data.

The printer unit 314 converts the raster image data that has been expanded by the RIP 308 into an image on a paper sheet. Methods for converting raster image data into an image on a paper sheet by the printer unit 314 include an electro-photographic system that employs a photosensitive drum or a photosensitive belt, an ink jet system that ejects ink from a fine nozzle array to thereby print an image directly onto a paper sheet, and the like. The printer unit 314 may use any one of these systems. The printer unit 314 starts activation of a print operation in accordance with the instruction given by the CPU 301.

Figure 3A:
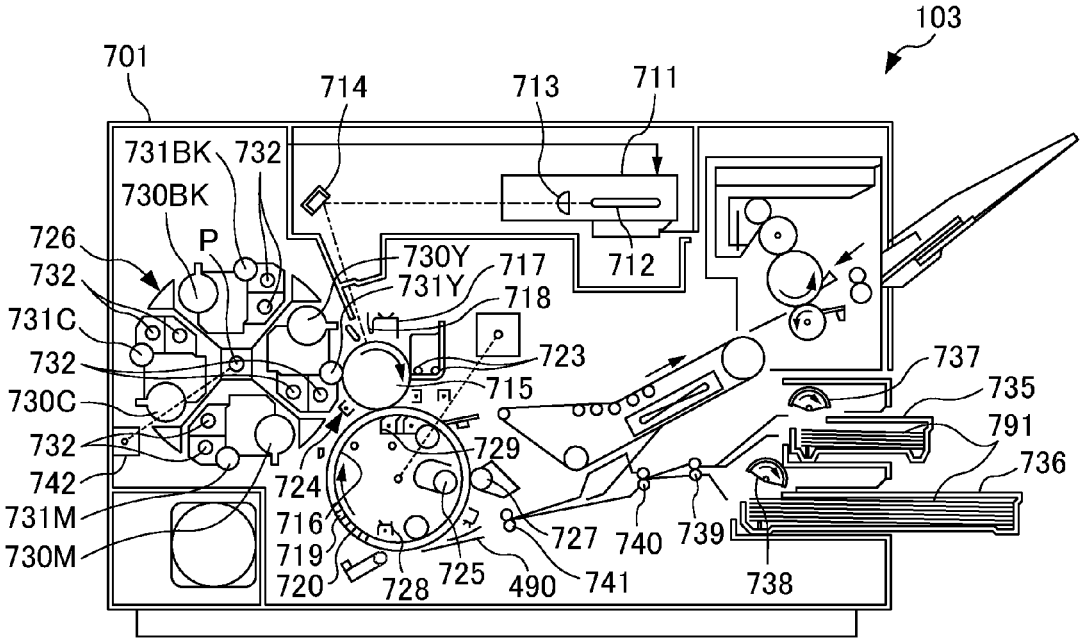
FIG. 3A is a cross-sectional diagram illustrating an example of a device.
Figure 3B:
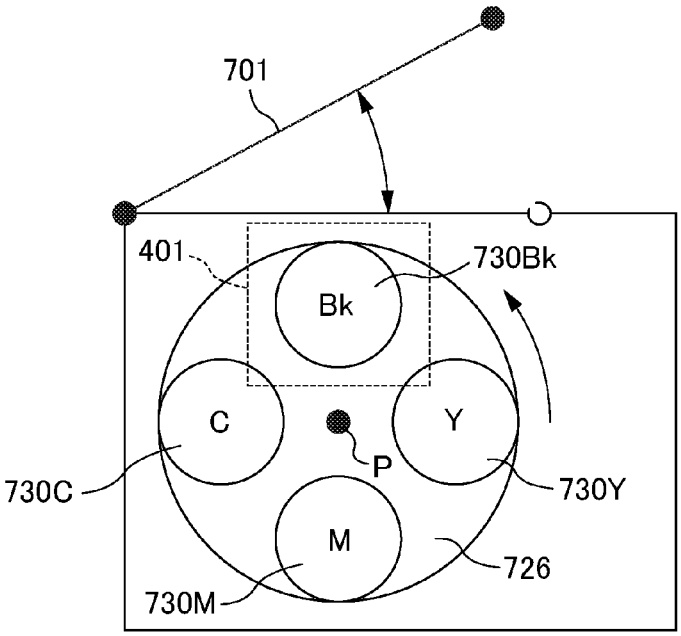
FIG. 3B is a diagram illustrating a framework for replacing a toner cartridge provided in a device.

FIGS. 3A and 3B are a cross-sectional diagram illustrating an example of a device shown in FIG. 1A and a diagram illustrating a framework for replacing a toner cartridge provided in the device, respectively. FIG. 3A is a cross-sectional diagram illustrating an example of the device 103. The device 103 shown in FIG. 3A is a color printing apparatus employing a rotation developing system. A scanner 711 provided in the device 103 includes a laser output unit that converts an image signal into an optical signal, a polygonal (e.g., octahedral) polygon mirror 712, a motor that rotates the polygon mirror 712, and an f/θ lens (imaging lens) 713.

The laser beam emitted from the laser output unit is reflected by the side surface of the polygon mirror 712, passes through the f/θ lens 713 and a reflection mirror 714, and scans line by line (raster scan) the surface of a photosensitive drum 715 that rotates in the direction of the illustrated arrow. With this arrangement, an electrostatic latent image corresponding to an image of an original document is formed on the surface of the photosensitive drum 715. A primary charger 717, a full surface exposure lamp 718, a cleaner unit 723 that collects residual toner not transferred to the paper sheet, and a pre-transferring charger 724 are arranged at the periphery of the photosensitive drum 715.

A developing unit 726 is a unit that develops an electrostatic latent image, which has been formed on the surface of the photosensitive drum 715, by laser exposure. The developing unit 726 has the configuration to be described below. More specifically, the development sleeves (731Y, 731M, 731C, 731Bk) provided in the developing unit 726 are brought into contact with the photosensitive drum 715 for direct development. Each of the toner cartridges (730Y, 730M, 730C, 730Bk) contains a reserve toner. A screw 732 transports a developing agent. The development sleeves (731Y, 731M, 731C, 731Bk), the toner cartridges (730Y, 730M, 730C, 730Bk), and the screw (732) are disposed around the central shaft P of the developing unit 726.

The reference symbols "Y", "M", "C", and "Bk" of the respective components described above indicate the colors thereof, where "Y" refers to yellow, "M" refers to magenta, "C" refers to cyan, and "Bk" refers to black. Hence, the reference number 730Y is a toner cartridge that contains yellow toner (yellow toner cartridge). The reference number 730M is a toner cartridge that contains magenta toner (magenta toner cartridge). The reference number 730C is a toner cartridge that contains cyan toner (cyan toner cartridge). And the reference number 730Bk is a toner cartridge that contains black toner (black toner cartridge).

A main body cover 701 is the cover that covers the main body of the device 103. The main body cover 701 is configured such that the user 101 can open and close the main body cover 701. The user 101 can remove only the toner cartridge that is located directly under the main body cover 701. The location directly under the main body cover 701 is referred to as the "replacement position". More specifically, among a plurality of toner cartridges, only one toner cartridge located at the replacement position is replaceable. In the example shown in FIG. 3A, the toner cartridge 730Bk is arranged at the replacement position. The toner color located at the replacement position can be changed by rotating the toner cartridges (730Y, 730M, 730C, 730Bk) about the shaft P.

In the case of performing monochrome printing or color printing, the device 103 can start printing in the quickest manner when the standby position of a toner cartridge is the standby position in which the toner cartridge 730Bk is arranged at the replacement position. However, depending on the engine configuration, the standby position at which the device 103 can start printing in the quickest manner may be the standby position in which a toner cartridge that contains color toner other than the black toner cartridge is present at the replacement position. Also, the standby position at which the device 103 can start printing in the quickest manner may be different between monochrome printing and color printing.

A developing unit position sensor 742 detects the rotation position of the developing unit 726. When the yellow toner image is formed, the developing unit 726 performs yellow toner development processing at the position shown in FIG. 3A. When the magenta toner image is formed, the developing unit 726 rotates about the shaft P such that the development sleeve (731M) in the magenta developer is brought into contact with the photosensitive drum 715. When the cyan and the black toner images are developed, the developing unit 726 operates in the same manner. A transfer drum 716 transfers a toner image formed onto the photosensitive drum 715 to a paper sheet. An actuator plate 719 detects the moving position of the transfer drum 716. A position sensor 720 is brought into close contact with the actuator plate 719 to thereby detect the fact that the transfer drum 716 has moved to the home position.

The actuator plate 719, the position sensor 720, a transfer drum cleaner 725, a paper retaining roller 727, and a neutralizer 729 are transfer chargers that are disposed around a transfer roller 716. On the other hand, each of paper-feeding cassettes (735 and 736) contains a paper sheet (paper leaf body) 791. For example, it is assumed that A4-sized paper sheets are contained in the paper-feeding cassette 735 and A3-sized paper sheets are contained in the paper-feeding cassette 736. When a paper sheet is fed and transferred, a paper sheet is fed from the cassette (735, 736) by the paper feeding roller (737, 738). Timing rollers (739, 740, and 741) determine the timing of paper feeding and paper transferring. A paper sheet passes through these rollers and is guided into a paper guide 490. Then, the front edge of the paper sheet is gripped by a gripper 728, while the paper sheet is wrapped around the transfer drum 716. With this arrangement, the operation of the device 103 proceeds to an image forming process. By having the aforementioned configuration, the device 103 can realize full color printing corresponding to four colors, i.e., YMCK.

FIG. 3B is a diagram illustrating a framework for replacing a toner cartridge provided in a device. When a toner cartridge is replaced, a user opens the main body cover 701. The position directly under the main body cover 701, which can be viewed by opening the main body cover 701, is a replacement position 401 at which a toner cartridge can be replaced. A user can replace a toner cartridge located at the replacement position 401. In the example shown in FIG. 3B, the toner cartridge 730Bk can be replaced. Note that the replacement position 401 of the toner cartridge is not limited to the position shown in FIG. 3B, but may differ depending on the structure of the device 103.

Each of the toner cartridges is mounted on the developing unit 726 that rotates about the shaft P. When the device 103 receives a replacement position movement instruction from the controller unit 313, the device 103 rotates the developing unit 726, and moves the specified toner cartridge to the replacement position.

Irrespective of whether the device 103 performs monochrome printing or color printing, it is assumed that the device 103 can start printing in the quickest manner when the standby position of a toner cartridge is the standby position (hereinafter referred to as a "specific standby position") where a black toner cartridge (730Bk) is at the replacement position. Even if "no toner" occurs in any one of the toner cartridges 730C, 730M, and 730Y, the device 103 may perform monochrome printing when the residual toner in the toner cartridge 730Bk exists. At this time, the controller unit 313 of the device 103 provides instructions to the printer unit 314 so as to move a toner cartridge in which "no toner" has occurred to the replacement position, resulting in an improvement in the usability in replacing toner.

When "no toner" occurs in a plurality of toner cartridges, the device 103 sequentially moves the toner cartridges in which "no toner" has occurred to the replacement position. In this manner, the operation mode of the device 103, which moves the toner cartridge in which the error has occurred to the replacement position by the controller unit 313 of the device 103, is referred to as a "toner replacement priority mode" (first operation mode). In other words, toner replacement priority mode is an operation mode that prioritizes avoiding an error relating to a recording material.

On the other hand, when the toner cartridge 730Bk (first recording material storage unit) is at the replacement position, the monochrome printing performance obtained by the device 103 may be achieved in the quickest manner. Thus, even if "no toner" occurs in a color cartridge among a plurality of toner cartridges, the controller unit 313 operates so as to move the toner cartridge 730Bk to the replacement position, whereby the monochrome printing performance may be achieved in the quickest manner. Among a plurality of toner cartridges, a color cartridge is a toner cartridge (second recording material storage unit) other than a first recording material storage unit (other than the toner cartridge 730Bk). A color cartridge is used for color printing.

The operation mode in which the controller unit 313 moves a toner cartridge to the standby position (specific standby position), where printing is started in the quickest manner using a black toner cartridge, after completion of monochrome printing is referred to as a "monochrome performance priority mode". The monochrome performance priority mode is the second operation mode of the device 103, and prioritizes the monochrome printing performance. When the device 103 is set to monochrome performance priority mode, the device 103 moves the black toner cartridge to the replacement position after completion of monochrome printing even if an error occurs in a toner cartridge(s) other than the black toner cartridge.

While, in the present embodiment, the standby position at which printing is started in the quickest manner using a black toner cartridge is the specific standby position, the specific standby position may not limited to the standby position at which printing is started in the quickest manner using a black toner cartridge. For example, the standby position at which printing is started in the quickest manner using a toner cartridge of any color or the color selected by the user specification may also be the specific standby position.

When the residual toner in the toner cartridges of four colors exists, the printing performance may be achieved in the quickest manner with the toner cartridge 730Bk placed at the replacement position. Thus, when the device 103 is in standby mode, the controller unit 313 performs control such that the toner cartridge 730Bk stands by at the replacement position, and sets the operation mode to toner replacement priority mode.

When an error relating to a color cartridge occurs during color printing, that is, during the print operation using a color cartridge, the controller unit 313 performs the following processing. The controller unit 313 determines whether monochrome printing is performed or the color cartridge in which the error has occurred has been replaced. The controller unit 313 switches the operation mode of the device 103 between toner replacement priority mode and monochrome performance priority mode depending on the determination result (functions as a switching unit). The controller unit 313 functions as the switching unit, whereby both the usability in replacing toner and the monochrome printing performance can be achieved.

Figure 4:
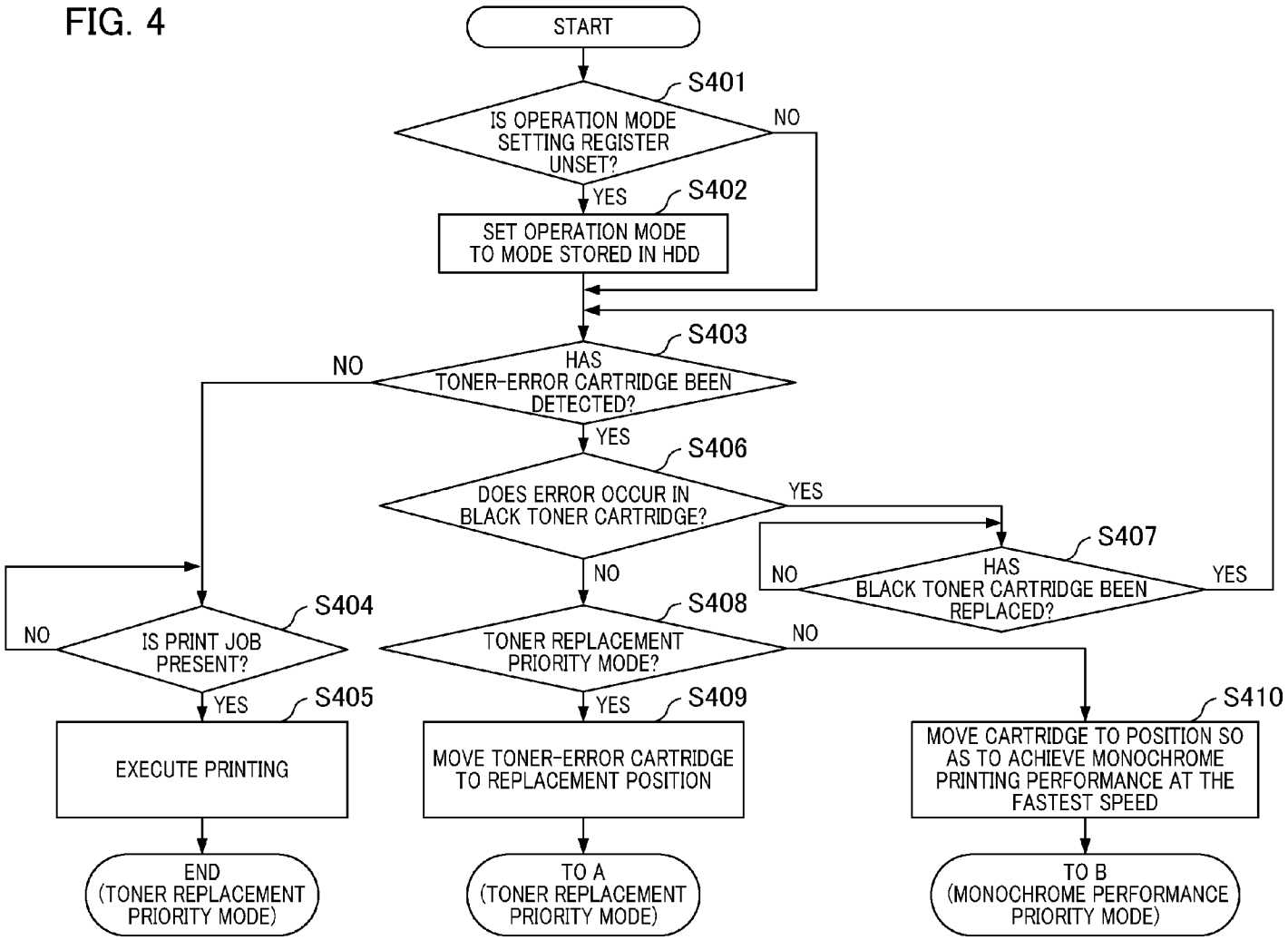
FIG. 4 is a flowchart illustrating an example of processing that confirms the state of a device and a toner cartridge prior to the execution of print processing and moves the toner cartridge to the standby position depending on the operation mode.
Figure 5:
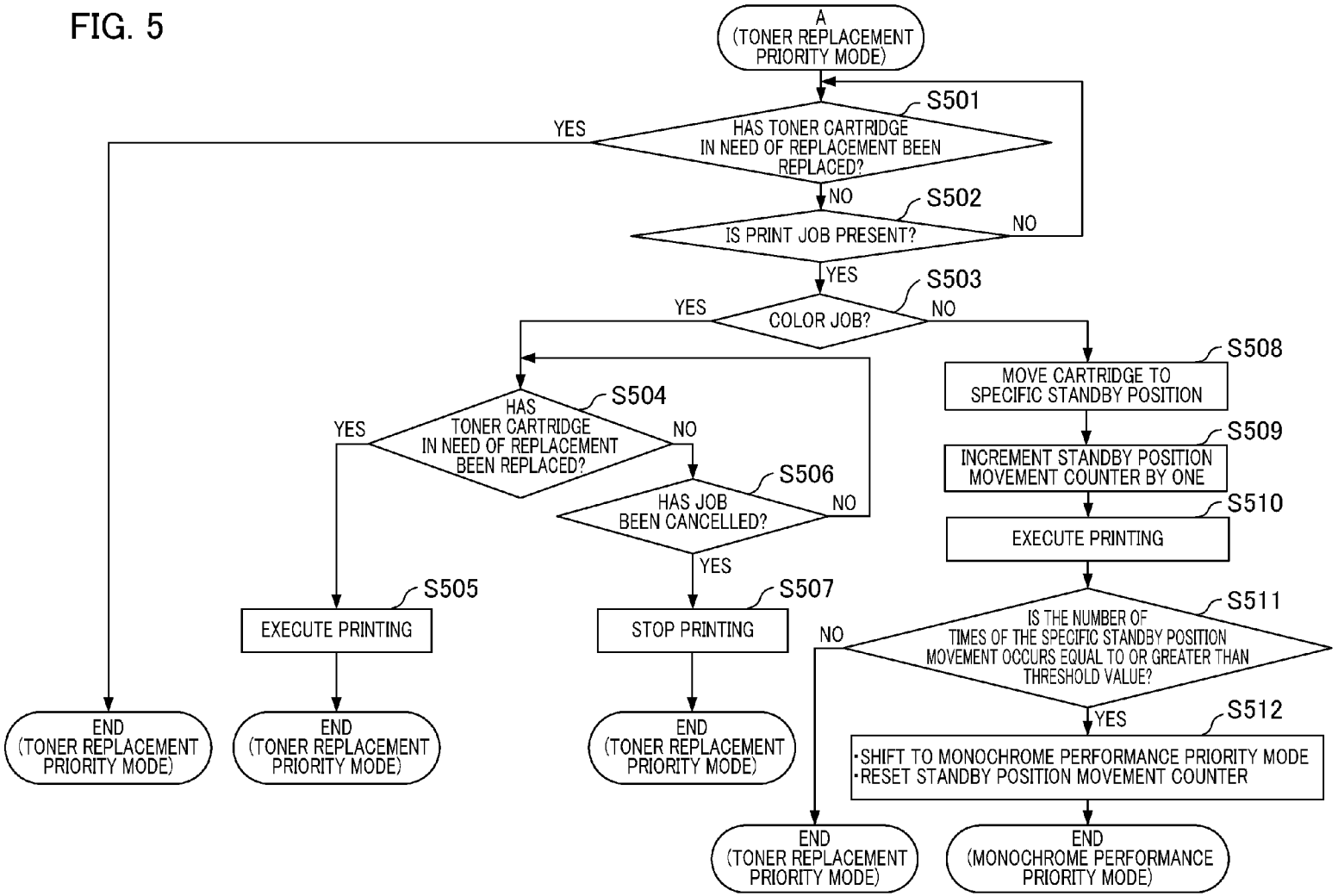
FIG. 5 is a flowchart illustrating an example of processing performed when print data is received during toner replacement priority mode.
Figure 6:
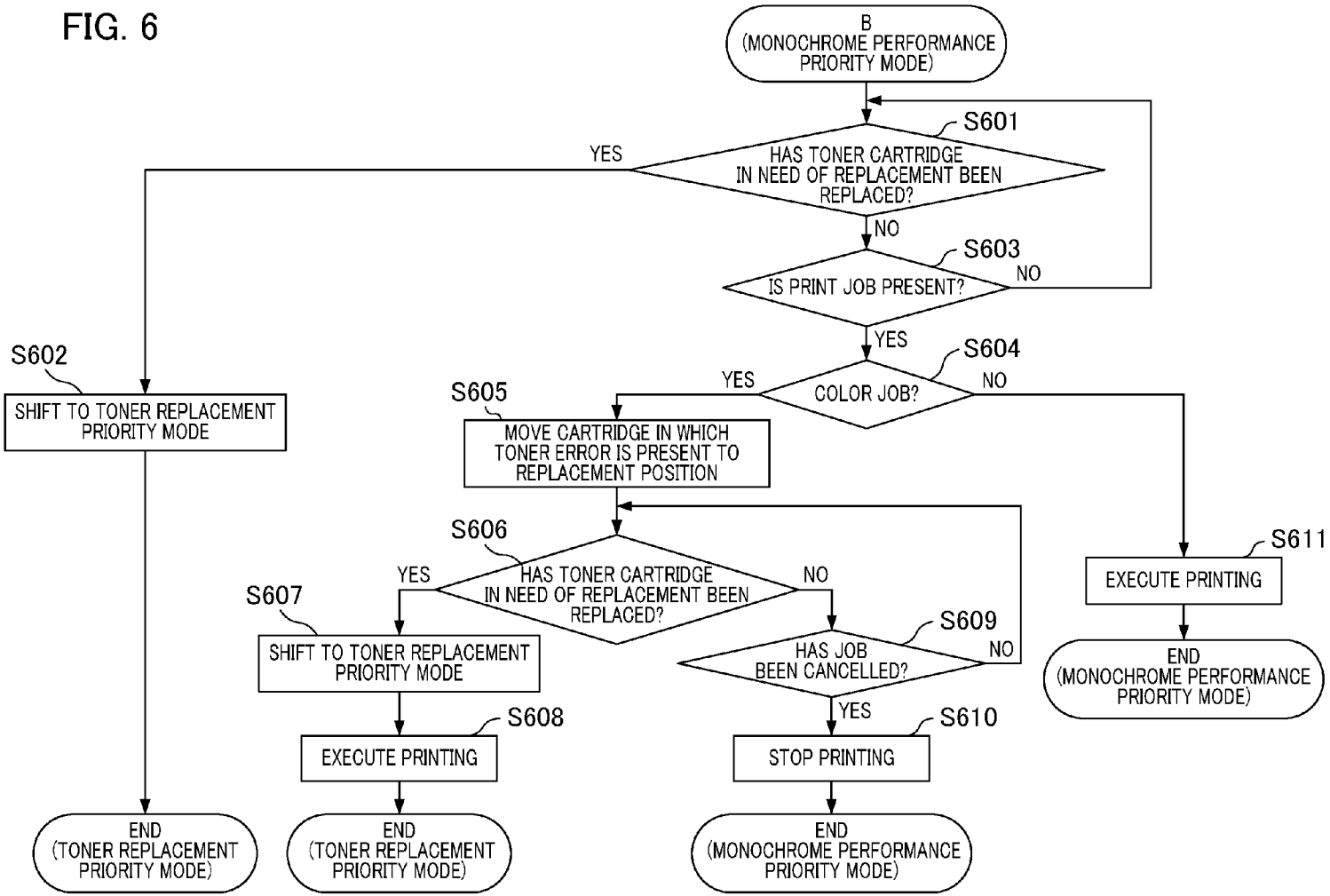
FIG. 6 is a flowchart illustrating an example of processing performed when print data is received during monochrome performance priority mode.

Each of FIGS. 4 to 6 is a flowchart illustrating an example of the switching process between toner replacement priority mode and monochrome performance priority mode according to the first embodiment of the present invention. In this example, an error relating to a toner cartridge (toner error) is intended to be "no toner". Also, the default operation mode of the device 103 is toner replacement priority mode. If no error occurs in all of the toner cartridges, the device 103 operates in toner replacement priority mode.

In FIG. 4, the controller unit 313 confirms whether or not an operation mode setting register is not set (step S401). The operation mode setting register is a register for holding the operation mode of the device 103. When the controller unit 313 confirms in step S401 that the operation mode setting register is not set, the controller unit 313 reads information about the operation mode stored in the HDD 203, and sets the operation mode (step S402). This is for the sake that, when a power supply is turned ON, the device 103 can operate in a state where the previous operation mode set when the power supply was turned OFF is held. Hence, the controller unit 313 stores the operation mode in the HDD 203 when a power supply is turned OFF. When the controller unit 313 has confirmed in step S401 that the operation mode setting register has already been set, the process advances to step S403.

The controller unit 313 determines whether or not the toner cartridge in which the toner error has occurred has been detected by a residual toner sensor (not shown) (step S403). When the device 103 is in standby mode with no toner error, the controller unit 313 determines whether or not a printing instruction has been made by the PC 102 or the like (step S404). When a printing instruction has not been made, the process returns to step S404. When a printing instruction has been made, the process advances to step S405, and the controller unit 313 executes printing (step S405). Then, the process is ended. In this case, the operation mode remains in toner replacement priority mode.

When the toner cartridge in which the toner error has occurred has been detected in step S403, the process advances to step S406. The controller unit 313 confirms whether or not the black toner cartridge (the toner cartridge 730Bk) is ready for use (step S406). When the toner cartridge 730Bk is unavailable because of, for example, "no toner", printing cannot be performed. Thus, in this case, the controller unit 313 determines whether or not the toner cartridge 730Bk has been replaced (step S407). When the toner cartridge 730Bk has not been replaced, the process returns to step S407. When the toner cartridge 730Bk has been replaced, the process returns to step S403.

When it has been determined in step S406 that the toner cartridge 730Bk is ready for use, the process advances to step S408. Determining in step S406 that the toner cartridge 730Bk is ready for use means that an error relating to a color toner different from the black toner, i.e., an error relating to a color cartridge, has been detected. In step S408, the controller unit 313 determines whether or not the current operation mode is toner replacement priority mode (step S408). In other words, the controller unit 313 functions as a determination unit configured to determine the operation mode of the device 103 when an error relating to a color recording material different from a black recording material has been detected.

The controller unit 313 moves a toner cartridge that contains toner for which the error has been detected to a different position depending on the determination of the operation mode in step S408. More specifically, when it has been determined in step S408 that the operation mode is toner replacement priority mode, the process advances to step S409. The controller unit 313 moves the toner cartridge in which the toner error has been detected to the replacement position (step S409). When it has been determined in step S408 that the operation mode is monochrome performance priority mode, the process advances to step S410. The controller unit 313 moves the toner cartridge 730Bk to the replacement position so as to achieve the monochrome printing performance in the quickest manner (step S410).

FIG. 5 is a flowchart illustrating an example of processing performed when a print job is received after the execution of processing in step S409 shown in FIG. 4, i.e., during the period while the operation mode is toner replacement priority mode. The controller unit 313 determines whether or not the toner cartridge in need of replacement has been replaced (step S501). When the toner cartridge in need of replacement has been replaced, the controller unit 313 maintains the operation mode of the device 103 in toner replacement priority mode, and the process advances to step S401 shown in FIG. 4. Since both of the conditional clauses in steps S401 and S403 are "No", the process advances up to step S404, and the device 103 stands by until a job is input thereto.

When the toner cartridge in need of replacement has not been replaced in step S501, the process advances to step S502, and the controller unit 313 determines whether or not a printing instruction has been made by the PC 102 or the like (step S502). When the printing instruction has not been made, the process returns to step S501. When the printing instruction has been made, the process advances to step S503, and the controller unit 313 determines whether or not the printing instruction is a color job (step S503). When the printing instruction is a color job, the process advances to step S504, and the controller unit 313 determines whether or not the toner cartridge in need of replacement has been replaced (step S504). When the toner cartridge in need of replacement has been replaced, the controller unit 313 executes printing (step S505). In this case, the operation mode of the device 103 is maintained in toner replacement priority mode.

When the toner cartridge in need of replacement has not been replaced in step S504, the process advances to step S506. Then, the controller unit 313 confirms whether or not a job has been cancelled (step S506). When a job has not been cancelled, the process returns to step S504. When a job has been cancelled, print processing is interrupted (step S507). Also in this case, the operation mode of the device 103 is maintained in toner replacement priority mode.

When a job is a monochrome job as a result of determination in step S503, the process advances to step S508. The controller unit 313 moves the toner cartridge to the specific standby position (step S508). More specifically, the controller unit 313 moves the toner cartridge to the standby position in which the toner cartridge 730Bk is at the replacement position. Specifically, the controller unit 313 provides instructions to the printer unit 314 so as to move the toner cartridge arrangement position from the arrangement position in which the color cartridge is at the replacement position to the specific standby position.

Next, the controller unit 313 increments the count value of a standby position movement counter (step S509). The standby position movement counter counts the number of times of specific standby position movement. The number of times of specific standby position movement is the number of times that the controller unit 313 has changed the toner cartridge arrangement position from the arrangement position in which the color cartridge is at the replacement position to the specific arrangement position. In other words, the number of times of specific standby position movement corresponds to the number of times a monochrome printing job has been executed without resolving the error occurring in the color cartridge(s).

Here, the time during which the controller unit 313 moves the toner cartridge arrangement position from the arrangement position in which the color cartridge is at the replacement position to the specific arrangement position may take, for example, a few seconds. Thus, the start of monochrome printing is delayed by an equivalent amount, resulting in a deterioration of the monochrome printing performance. Accordingly, the controller unit 313 counts the number of times of specific standby position movement, and switches the operation mode to monochrome performance priority mode based on the comparison result between the number of times of specific standby position movement and the threshold value (to be described below with reference to steps S511 and S512).

Next, the controller unit 313 starts monochrome printing (step S510). When printing is completed, the controller unit 313 compares the counted number of times of specific standby position movement with a threshold value, and determines whether or not the number of times of specific standby position movement is equal to or greater than a threshold value (step S511). The threshold value is defined in advance based on, for example, experiments or experience. When the number of times of specific standby position movement is equal to or greater than a threshold value, the controller unit 313 switches the operation mode of the device 103 to monochrome performance priority mode (step S512).

In step S512, the controller unit 313 further resets a count value counted by a standby position movement counter. At this time, since the operation mode of the device 103 is switched and shifted to monochrome performance priority mode and an error is present in a color cartridge other than the toner cartridge 730Bk, the process advances up to step S410 in the flowchart shown in FIG. 4. In step S410, the controller unit 313 moves the toner cartridge to the specific standby position, that is, the arrangement position at which the monochrome printing performance is achieved in the quickest manner (step S410 in FIG. 4).

Referring back to FIG. 5, when the counted number of times of specific standby position movement is less than a threshold value in step S511, the operation mode of the device 103 is maintained in toner replacement priority mode. At this time, since the operation mode of the device 103 is toner replacement priority mode and an error is present in a color cartridge other than the toner cartridge 730Bk, the process advances up to step S409 in the flowchart shown in FIG. 4. In step S409, the controller unit 313 moves the toner cartridge in which the toner error has occurred to the replacement position (step S409 in FIG. 4).

As described with reference to FIGS. 4 and 5, if it is determined that the operation mode of the device 103 is toner replacement priority mode when an error relating to a color recording material different from a black recording material has been detected (Yes in S408 shown in FIG. 4), the controller unit 313 performs the following processing. When the number of times a monochrome printing job has been executed is equal to or greater than a threshold value without resolving the error (No in step S501 and Yes in step S511 shown in FIG. 5), the controller unit 313 switches the operation mode of the device 103 to monochrome performance priority mode (step S512).

FIG. 6 is a flowchart illustrating an example of processing performed when a print job is received after execution of processing in step S410 in FIG. 4, i.e., during the period while the operation mode is monochrome performance priority mode. The controller unit 313 determines whether or not the toner cartridge in need of replacement has been replaced, that is, the error has been resolved (step S601). When the toner cartridge in need of replacement has been replaced, the controller unit 313 switches the operation mode of the device 103 to toner replacement priority mode, and the process advances to step S401 in FIG. 4. Since the conditional clause in steps S401 and S403 is "No", the process advances up to step S404, and the device 103 stands by until a job is input thereto.

When the toner cartridge in need of replacement has not been replaced in determination processing performed in step S601, the controller unit 313 determines whether or not a printing instruction has been made by the PC 102 or the like, that is, a print job is present (step S603). When a printing instruction has not been made, the process returns to step S601. When a printing instruction has been made, the controller unit 313 determines whether or not a printing instruction is a color job, that is, a color printing instruction has been made (step S604).

When a color printing instruction has been made, the controller unit 313 moves the cartridge in which a toner error is present (in this example, a color cartridge) to the replacement position (step S605). When a toner error is present in a plurality of cartridges, the controller unit 313 sequentially moves the cartridge in which a toner error is present to the replacement position one by one. The sequences in which the controller unit 313 moves the toner cartridge to the replacement position is determined in advance depending on the engine configuration. Also, after the controller unit 313 has moved the cartridge, in which a toner error is present, to the replacement position, the controller unit 313 moves a next cartridge in which a toner error is present to the replacement position using, for example, the detection of the cartridge replacement as a trigger. It should be noted that the trigger may be the opening/closing of the main body cover 701 or may be the elapse of predetermined time after the cartridge in which a toner error is present has been moved to the replacement position.

Next, the controller unit 313 determines whether or not the cartridge in need of replacement has been replaced, that is, the error has been resolved (step S606). When the cartridge in need of replacement has been replaced, the controller unit 313 switches the operation mode of the device 103 to toner replacement priority mode (step S607). This is because the replacement of all of the cartridges in need of replacement enables a color job to be printed and further allows determining that a user has indicated a desire to execute color job printing. Then, the controller unit 313 starts printing (step S608). The processing to be performed after the start of printing in step S608 is the same as that described with reference to FIGS. 4 and 5.

When the cartridge in need of replacement has not been replaced in step S606, the controller unit 313 determines whether or not a job has been cancelled (step S609). When the job has not been cancelled, the process returns to step S606. When the job has been cancelled, the controller unit 313 stops print processing (step S610). At this time, the operation mode of the device 103 is maintained in monochrome performance priority mode. Since an error is present in a color cartridge(s) other than the toner cartridge 730Bk, the process advances up to step S410 in the flowchart shown in FIG. 4. In step S410, the controller unit 313 moves the toner cartridge to the specific standby position, that is, the arrangement position at which the monochrome printing performance is achieved in the quickest manner (step S410 in FIG. 4).

As described with reference to FIGS. 4 and 5, when an error relating to a color cartridge occurs during color printing and the operation mode of the device 103 is toner replacement priority mode, the controller unit 313 performs the following processing. The controller unit 313 determines whether monochrome printing is to be performed (No in step S503 shown in FIG. 5) or the color cartridge in which the error has occurred has been replaced (step S504 in FIG. 5). When the controller unit 313 determines that monochrome printing is to be performed, the controller unit 313 switches the operation mode of the device 103 from toner replacement priority mode to monochrome performance priority mode (step S512 in FIG. 5).

As described with reference to FIG. 6, when an error relating to a color cartridge occurs during color printing and the operation mode of the device 103 is monochrome performance priority mode, the controller unit 313 performs the following processing. The controller unit 313 determines whether monochrome printing is to be performed (No in step S604 shown in FIG. 6) or the color cartridge in which the error has occurred has been replaced (step S606 in FIG. 6). Then, when the color cartridge in which the error has occurred has been replaced, the controller unit 313 switches the operation mode of the device 103 from monochrome performance priority mode to toner replacement priority mode (Yes in step S606 shown in FIG. 6, and step S607). Thus, according to the image forming apparatus of the first embodiment, the operation mode of the image forming apparatus may be switched to either an operation mode that prioritizes the replacement of a recording material storage unit for which the error has occurred or the other operation mode that starts printing using a particular recording material storage unit in the quickest manner depending on the state of the apparatus.

While, in the first embodiment, all printing is successfully completed during the execution of printing, it is similarly applicable to the case where printing is interrupted due to some cause. When printing is interrupted due to some cause, the controller unit 313 releases the printing state. Then, when printing may be resumed, data whose printing is not complete is transmitted again based on the job information managed by the PC 102 or the like or the controller unit 313 itself. The controller unit 313 treats the re-transmitted data as a new job, and resumes printing. For this reason, the flowcharts shown in FIGS. 4, 5, and 6 are also applicable to the case in which a toner error occurs during printing.

Next, a description will be given of a second embodiment of the present invention. In the second embodiment, when the operation mode of the device 103 is selected and input by a user's operation, the controller unit 313 switches the operation mode to either monochrome performance priority mode or toner replacement priority mode depending on the selection input result.

FIG. 7 is an example of a user interface for selectively inputting the operation mode of the device 103. A UI application operating on the PC 102 displays a user interface shown in FIG. 7 on a screen. As the operation mode settings to be made when "no color toner" occurs, a user may select either automatic switch mode or manually setting mode by using the user interface shown in FIG. 7.

Also, when a user selects to manually set the operation mode, the user may select whether to set the operation mode to be monochrome performance priority mode or to set the operation mode to be toner replacement priority mode. The UI application passes the user selection input result to the controller unit 313 of the device 103, and the controller unit 313 sets the operation mode settings to be made when "no color toner" occurs to the operation mode in response to the passed selection input result. In the example shown in FIG. 7, a user selects monochrome performance priority mode.

Next, a description will be given of a third embodiment of the present invention. In the third embodiment, the controller unit 313 associates information indicating a tendency of a user's print operation with the user and stores the associated information in a predetermined storage unit. When a user starts a print operation, the controller unit 313 acquires information indicating a tendency of a print operation corresponding to the user from the storage unit. Then, the controller unit 313 changes a threshold value to be compared with the number of times of specific standby position movement based on the acquired information indicating a tendency of a print operation. The threshold value to be compared with the number of times of specific standby position movement is, for example, a threshold value to be compared with the number of times of specific standby position movement in step S511 shown in FIG. 5.

For example, when a user who often performs monochrome printing in the presence of an error in a color cartridge or a user who often performs simple monochrome printing carries out a print operation, the controller unit 313 sets the threshold value to "1". With this arrangement, the operation mode of the device 103 may be switched to monochrome performance priority mode by an occurrence of specific standby position movement one time. Also, when a user, who often continues to perform color printing in the occurrence of an error in a color cartridge, carries out a print operation, the controller unit 313 sets the threshold value to "2" or greater. With this arrangement, the operation mode of the device 103 is readily maintained in toner replacement priority mode. It should be noted that the controller unit 313 may set the threshold value to any value depending on a user's operational input.

According to the image forming apparatus of the present invention described above, the operation mode of the image forming apparatus may be switched to either an operation mode (first operation mode) that prioritizes the replacement of a recording material storage unit for which the error has occurred or the other operation mode (second operation mode) that starts printing using a particular recording material storage unit in the quickest manner depending on the state of the apparatus. Thus, according to the image forming apparatus of the present invention, a recording material storage unit for which the error has occurred can be controlled so as to be readily replaced, and the start of printing using a particular recording material storage unit can be suppressed from being delayed.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-210725 filed Sep. 21, 2010, which is hereby incorporated by reference herein in its entirety.

What is claimed is:

1. An image forming apparatus that rotationally moves a plurality of developing material storage units that store a developing material to thereby perform printing, the image forming apparatus comprising:

a moving unit configured to rotationally move the developing material storage unit;

a switching unit configured to switch the operation mode of the image forming apparatus to either a first operation mode that prioritizes avoiding an error relating to the developing material or a second operation mode that prioritizes a monochrome printing performance; and a determination unit configured to determine the operation mode of the image forming apparatus when an error relating to a color developing material different from a black developing material has been detected, wherein the moving unit moves a developing material storage unit that stores a developing material for which the error has been detected to a different position depending on the determination of the operation mode of the image forming apparatus by the determination unit, and wherein, when the determination unit determines that the operation mode of the image forming apparatus is the first operation mode and the number of times a monochrome printing job has been executed is equal to or greater than a threshold value without resolving the error, the switching unit switches the operation mode of the image forming apparatus to the second operation mode.

2. The image forming apparatus according to claim 1, wherein, when the determination unit determines that the operation mode of the image forming apparatus is the second operation mode and if the error has been resolved, the switching unit switches the operation mode of the image forming apparatus to the first operation mode.

3. The image forming apparatus according to claim 1, wherein, when the operation mode of the image forming apparatus is selected and input by a user, the switching unit switches the operation mode between the first operation mode and the second operation mode depending on the selection input result.

4. The image forming apparatus according to claim 1, wherein the switching unit associates information indicating the tendency of a print operation of the image forming apparatus performed by a user with the user and stores the resulting information in a storage unit, and wherein the switching unit changes the threshold value based on information indicating the tendency of the print operation.

5. A method for controlling an image forming apparatus that rotationally moves a plurality of developing material storage units that store a developing material to thereby perform printing, the method comprising:

moving, in a moving step, rotationally the developing material storage unit;

switching, in a switching step, the operation mode of the image forming apparatus to either a first operation mode that prioritizes avoiding an error relating to the developing material or a second operation mode that prioritizes a monochrome printing performance; and determining, in a determination step, the operation mode of the image forming apparatus when an error relating to a color developing material different from a black developing material has been detected, wherein, in the moving step, moving a developing material storage unit that stores a developing material for which the error has been detected to a different position depending on the determination of the operation mode of the image forming apparatus by the determination step, and wherein, when it is determined that the operation mode of the image forming apparatus is the first operation mode and the number of times a monochrome printing job has been executed is equal to or greater than a threshold value without resolving the error in the determination step, switching, in the switching step, the operation mode of the image forming apparatus to the second operation mode.

6. A computer readable storage medium on which is stored a computer program for making a computer execute a method for controlling an image forming apparatus that rotationally moves a plurality of developing material storage units that store a developing material to thereby perform printing, the method comprising:

moving, in a moving step, rotationally the developing material storage unit;

switching, in a switching step, the operation mode of the image forming apparatus to either a first operation mode that prioritizes avoiding an error relating to the developing material or a second operation mode that prioritizes a monochrome printing performance; and determining, in a determination step, the operation mode of the image forming apparatus when an error relating to a color developing material different from a black developing material has been detected, wherein, in the moving step, moving a developing material storage unit that stores a developing material for which the error has been detected to a different position depending on the determination of the operation mode of the image forming apparatus by the determination step, and wherein, when it is determined that the operation mode of the image forming apparatus is the first operation mode and the number of times a monochrome printing job has been executed is equal to or greater than a threshold value without resolving the error in determination step, switching, in the switching step, the operation mode of the image forming apparatus to the second operation mode.

* * * * *